United States Patent [19]

Macdonald

[11] Patent Number: 4,930,421

[45] Date of Patent: Jun. 5, 1990

[54] PARTITIONED, FLUID SUPPORTED, HIGH EFFICIENCY TRAVELING CHARGE FOR HYPER-VELOCITY GUNS

[75] Inventor: Kenneth A. B. Macdonald, Maple Valley, Wash.

[73] Assignee: The Boeing Company, Seattle, Wash.

[21] Appl. No.: 217,268

[22] Filed: Jul. 11, 1988

[51] Int. Cl.[5] ..... F42B 15/10

[52] U.S. Cl. ..... 102/377; 102/380; 102/432; 102/443; 102/700

[58] Field of Search ..... 102/374, 377, 378, 380, 102/430, 431, 432, 433, 443, 700

[56] References Cited

U.S. PATENT DOCUMENTS

| | | |
|---|---|---|
| 68,609 | 9/1867 | Crockett . |
| 162,901 | 5/1875 | Collett . |
| 255,542 | 3/1882 | Shaw . |
| 352,125 | 11/1886 | Graydon . |
| 373,529 | 11/1887 | Lombard . |
| 380,368 | 4/1888 | Van Tine . |
| 504,736 | 9/1893 | Maxim . |
| 1,447,023 | 2/1923 | Kaiser . |
| 1,920,075 | 7/1933 | Haenichen . |
| 2,114,214 | 4/1938 | Damblanc . |
| 2,434,652 | 1/1948 | Hickman . |
| 2,640,417 | 6/1953 | Bjork et al. . |
| 3,031,933 | 5/1962 | Kern et al. . |
| 3,038,384 | 6/1962 | Gaugler . |
| 3,184,182 | 5/1965 | May et al. . |
| 3,388,633 | 6/1968 | Kirshner . |
| 3,434,426 | 3/1969 | De Dapper . |
| 4,375,192 | 3/1983 | Yates et al. . |
| 4,428,293 | 1/1984 | Botwin et al. . |
| 4,502,649 | 3/1985 | Botwin et al. . |
| 4,712,465 | 12/1987 | MacDonald . |

FOREIGN PATENT DOCUMENTS 2934848 3/1981 Fed. Rep. of Germany .

*Primary Examiner*—Charles T. Jordan
*Assistant Examiner*—Richard W. Wendtland
*Attorney, Agent, or Firm*—Thomas W. Hennen

[57] ABSTRACT

A traveling charge projectile utilizes a microprocessor and a plurality of sequentially fired igniting-priming-expelling charges to initiate respective charge segments containing propellant, such as granular propellant, of predetermined grain size, to produce a more nearly constant pressure against the projectile base. Traveling charge propellant segments attached to the projectile move with the projectile as it accelerates in the gun barrel. At appropriate intervals during barrel transit, a firing signal initiates a charge which propels the aft most propellant segment away from the projectile into the hot gases and flame behind the projectile to fully ignite the propellant charge and repressurize the expanding breech volume immediately aft of the accelerating projectile. This design maintains a higher average pressure on the base of the projectile during barrel transit, and results in a higher projectile muzzle velocity. Optionally, the microprocessor and associated EEPROM may be reprogrammed up to the moment of firing, by means of programming pads on the exterior of the projectile which communicate with the microprocessor. The traveling charge projectile is a close sliding fit in a smooth bore gun tube and is supported by a gas film between the charge and the gun tube wall. This enables traveling charge mass fractons of 90% to be obtained.

18 Claims, 2 Drawing Sheets

FIG. 2
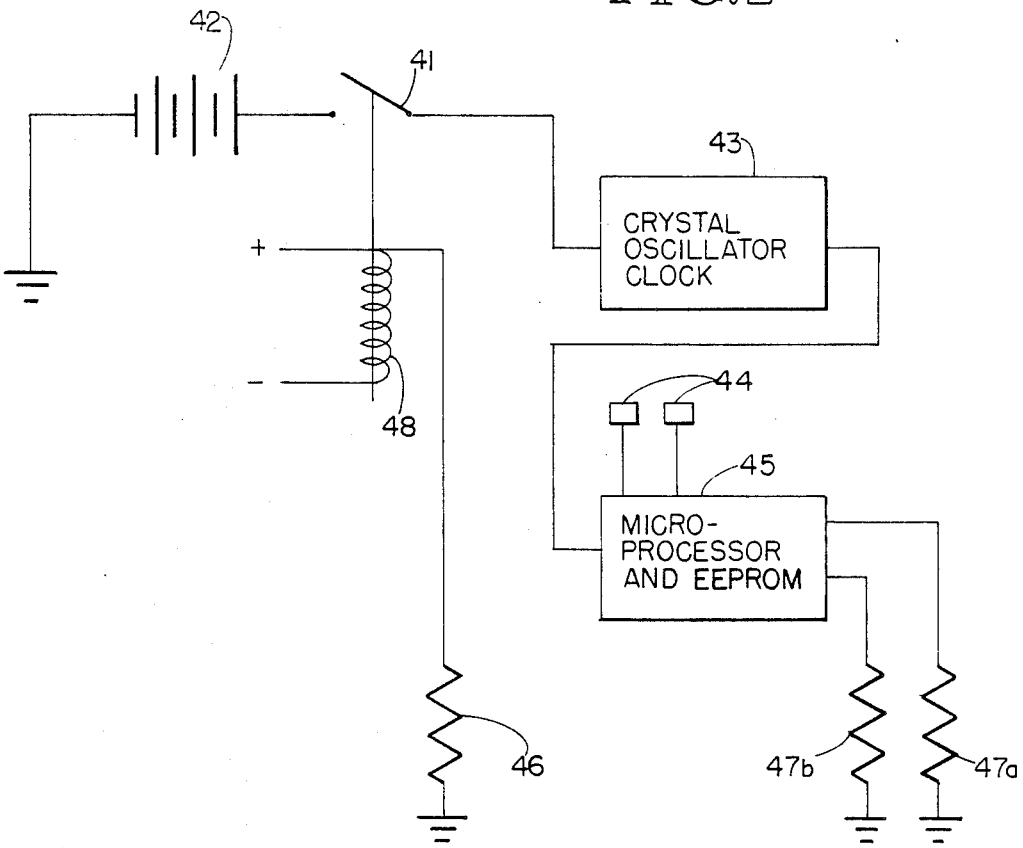
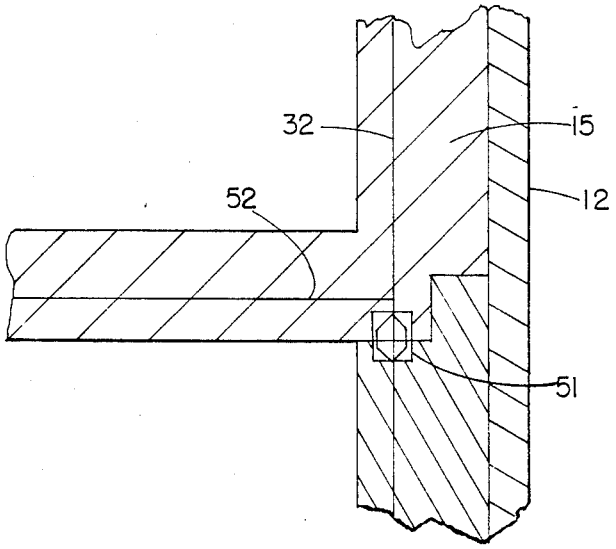
FIG. 3

PARTITIONED, FLUID SUPPORTED, HIGH EFFICIENCY TRAVELING CHARGE FOR HYPER-VELOCITY GUNS

BACKGROUND OF THE INVENTION

1. Field of the Invention

The present invention pertains to ordinance. With greater particularity, the present invention pertains to munition rounds for hyper-velocity guns. With greatest particularity, the present invention pertains to a munition round which has a multi-part, sequentially fired traveling charge which maintains a longer duration high pressure impulse on the projectile while in the gun barrel than conventional breech fired charges.

2. Description of the Prior Art

The art of munitions is old and well developed. Gun systems typically include a tubular barrel having a bore and a sealed breech wherein a propellant charge is positioned. A projectile is placed in the bore of the barrel and against the propellant charge at the breech end of the gun barrel. When the gun is fired, the propellant is ignited to generate a large volume of high pressure gas. This pressure acts against the bore and sealed breech and against the base of the projectile. This unbalanced pressure on the projectile base causes an unbalanced force which accelerates the projectile toward the muzzle end of the gun barrel. The projectile achieves a high velocity as it reaches the muzzle and it continues out of the gun barrel and traverses a ballistic trajectory to the target.

There have been many attempts to increase the muzzle velocity of a projectile by modifying or tailoring the propellant charge to produce a more constant pressure impulse on the base of the projectile while it is traversing the barrel bore. If the projectile is considered to be a piston and if the propellant charge burns fast enough to be completely consumed before the projectile has moved far from the breech, then it may be seen that the chamber pressure initially increases rapidly to a maximum. From the point the propellant is completely consumed, as the projectile continues to move toward the muzzle, the confined volume behind the projectile increases, leading to a rapid decrease in pressure on the base of the projectile. Obviously, the higher the average pressure accelerating the projectile during the time the projectile is in the barrel, the higher the muzzle velocity will be, all other factors being equal.

Typical of attempts to tailor chamber pressure has been the staging or sequential ignition of multiple propellant charges in the breech of the gun while the projectile moves through the bore, and as the confined volume behind the projectile increases.

One such attempt placed multiple charges in the breech in stacked fashion, adjacent charges being linked by a coiled cable which is attached to a ball projectile. As the first charge is fired, the ball begins moving down the barrel and trailing the cable. At the limit of the first cable coil, the cable begins to tear into the second charge, exposing it to the hot gases produced when the first charge was fired. This process continues until the last charge is fired just prior to the ball reaching the muzzle. This scheme is said to produce a higher average pressure on the ball projectile while it is in the barrel as compared to a single breech charge, and results in a higher muzzle velocity. Although the cable moves with the ball, the charges do not, and so this cannot be said to be a traveling charge.

All breech charges are limited in their ability to maintain a significant pressure on the projectile base by the expansion rate of the propelling gas which limits the pressure which it can apply to the projectile, and the need to accelerate the whole of the breech charge gas to half the velocity of the projectile, which consumes much energy.

Another attempt to increase muzzle velocity of a gun fired projectile in a rifled gun involved a cartridge which was attached to a projectile and had a series of rear facing propellant containing cups stacked behind the projectile in a shell. The base of each cup had a passageway for hot gases which communicated with the next cup. The passageway could be angled or coiled to delay ignition of the next charge to allow the projectile to move to an optimum position for subsequent charge ignition. The first charge accelerated the projectile and remaining cups. Periodically, another propellant charge would ignite and supply additional high pressure gas behind the projectile. This scheme differed from the one discussed above in that here the unignited propellant charges moved with the projectile instead of remaining in the breech. Thus, this attempt did constitute a traveling charge.

Yet another attempt to solve the projectile muzzle velocity problem involved placing a second propellant charge within the projectile and firing that second charge when the projectile is at an intermediate position in its travel down the barrel, at the moment of maximum gas pressure.

Other attempts to solve this problem have included using a second charge in the breech to fire a piston which compresses gases at the base of the projectile to thereby increase the average pressure-time impulse acting on the projectile base and cause the projectile to reach a higher muzzle velocity.

One prior art projectile used a series of stages to provide additional impulses during the flight of the projectile after leaving the muzzle. Still another approach used multiple charges and hot gas passageways to control ignition timing of the respective charges. Yet another approach involved using a shaped projectile and a series of explosive charges to accelerate the projectile by triggering the charges to explode just as the curved aft portion of the projectile passes pre-designated points while traversing the barrel bore.

Current attempts to develop the traveling charge for high velocity guns usually utilize a cigarette burn type charge which burns only on the rear face of the propellant at ever increasing burn rate to sustain pressure on the base of the projectile. Several problems have been encountered with a cigarette burn approach, such as:

(a) Burn rate and base pressure are limited by the tendency of the propellant to explode if its break-up is induced by excessive stress.

(b) Since the cigarette burn requires an increasing burn-rate as the traveling charge moves down the bore, the charge must be carefully tailored to contain increasing proportions of high burn rate propellant which is expensive and requires much development to maintain stable burning and obtain optimum velocity.

(c) High burn rate propellants are difficult to handle safely under field conditions.

(d) Experimental experience is limited to comparatively small bores and may not be confidently extrapolated to large bores without risk of propellant break-up and detonation.

(e) Once a cigarette burn traveling charge is tailored it is only suitable for one muzzle velocity.

Prior attempts to increase muzzle velocity have been limited in effectiveness by the mechanical or pyrotechnic means used to time firing of the sequential charges. These mechanical or pyrotechnic devices are notoriously inaccurate and unreliable when called upon to control the timing of charges that must be fired within milliseconds or microseconds of one another. Unless the charges are fired in a precise timed sequence, the optimum muzzle velocity will not be attained.

A further problem in the prior art is that even if prior devices were able to produce the desired muzzle velocities, the construction of the projectile and the traveling charge is such that they must withstand the full stresses caused by setback forces in the contained propellant or high explosive due to projectile acceleration and the centrifugal and torque forces generated by engagement with rifling in the gun bore as the gun is fired and the rifling begins to revolve the projectile to a high rate of rotation. The added structural mass of the projectile to enable it to withstand these high stresses greatly limits the amount of propellant and explosive payload the projectile can carry (to about 10% of its overall mass). This greatly increases the pressure required to accelerate it to achieve the stated muzzle velocity which increases the weight of the projectile and the gun barrel and limits the destructive power of the projectile.

BRIEF DESCRIPTION OF THE INVENTION

These and other problems in the prior art have been overcome by the present invention which provides an improved traveling charge and means for controlling the sequential firing of the individual charge segments. Further, the present invention provides higher mass fraction traveling charges and warheads and longer barrel life.

The present invention includes a projectile having a hollow payload section for use in a smooth-bore gun barrel which may or may not include a rifled section near the breech. In this regard, U.S. Pat. No. 4,712,465 should be reviewed and is incorporated by reference herein. It further includes a plurality of stacked propellant charge segments which are attached to the aft end of the projectile for sequential ignition controlled in real time by a computer programmed to obtain the optimum timing sequence to fire each propellant charge segment as the projectile moves down the bore. Alternatively, in the case of guided projectiles or missiles, the firing sequence may be performed by the guidance system incorporated in the payload.

The hollow projectile may be filled with a suitable payload, such as an energetic material and an appropriate initiating mechanism to produce a high explosive shell for bombardment or anti-aircraft fire. The hollow projectile could alternatively contain a payload for placement into orbit around the earth, or a scientific instrument payload for sampling properties of the upper atmosphere, for example. The mission to be undertaken by this device is only limited by the ability of the payload to withstand the large accelerations produced by the gun, however solid state avionics, which comprise most scientific payloads and guidance systems, can easily withstand gun acceleration.

To re-cap, the major advantages of the present invention are:

Muzzle velocity is no longer limited by the expansion rate of the propelling gases since the expansion rate of the traveling charge propellant is always relative to the projectile since the charge is an impulse engine attached to the projectile. Thus, it will continue to provide large impulses irrespective of projectile absolute velocity. It is expected that muzzle velocities over 20,000 feet per second will be achievable, especially at high altitude or in the vacuum of low earth orbit, making it ideal for providing anti-ballistic missile warheads for mid-course intercept or strategic bombardment.

Propellant is the inexpensive granular variety used in breech charges where burn-rate is increased by decreasing grain size. This powder may or may not be mixed with a liquid propellant to more evenly spread set back forces to the case and provide more energy per unit volume.

Propellant is proven safe to use and inexpensive to mass produce.

The traveling charge case being gas supported (as described in U.S. Pat. No. 4,712,465) in a close fitting smooth bore can provide mass fractions of about 90% compared to 10% for a conventional gun.

Segmented traveling charges can be mass produced and assembled into cases which will provide the correct muzzle velocities for a multitude of ranges.

Computer control of the sequencing of segment firing will provide optimum muzzle velocity.

It is expected that the propulsive efficiency of the traveling charge and gun combination will approach 60% in long guns, compared with the 3 or 4% efficiency of solid propellant rocket boosters, and about 30% for conventional guns. The high propulsive efficiency of the traveling charge is to some extent due to the fact that only a small fraction of the Propulsive charge is accelerated to projectile velocity rather than the whole charge to half projectile velocity as in a conventional gun.

Traveling charge dollar cost per pound should be an order of magnitude less than that of solid rocket motors.

Applies to guns from 20 mm upwards through field and naval artillery and on to large space booster tubes 10 to 30 feet in diameter.

Additional objects and advantages of the present invention will be appreciated when reference is made to the detailed description of the preferred embodiment which follows, taken in combination with the appended drawing figures.

BRIEF DESCRIPTION OF THE DRAWING

A better understanding of the structure and function of the present invention may be gained by referring to the appended drawing figures, wherein:

FIG. 2 illustrates an electronic implementation of a traveling charge segment firing pulse timing circuit;

FIG. 3 illustrates the junction between successive charge segments; and

DETAILED DESCRIPTION OF THE PREFERRED EMBODIMENT

A conventional projectile in a gun barrel may be likened to a piston in a cylinder. As the propelling charge fires, a very high pressure is developed which pushes against the base of the projectile, accelerating it down the barrel. As the projectile moves, the volume behind the projectile increases. If the propellant has a very fast burn rate the pressure on the base of the projectile is maximum just as the projectile begins to move. From that point on, the increasing volume behind the projectile causes the gas pressure on the base of the projectile to decay. Also, at high projectile speeds, the pressure which the breech fired charge can maintain on the base of the projectile, is severely limited by its own expansion rate and the need to accelerate the whole of the breech charge gas to half the projectile speed; this absorbs much of the available energy and decreases gun efficiency.

The present invention seeks to provide a pressure on the base of the projectile which is more nearly constant during the time after firing that the projectile is traveling in the gun barrel giving a higher total impulse by providing a higher average pressure for a longer period of time. This is accomplished by sequentially firing partial charges attached to the projectile as the projectile moves down the barrel to, essentially, repressurize the volume immediately behind the projectile to maintain the pressure on the base of the projectile in a sawtooth waveform fashion rather than allowing the pressure to spike and decay rapidly as in a conventional projectile.

Figure 1:
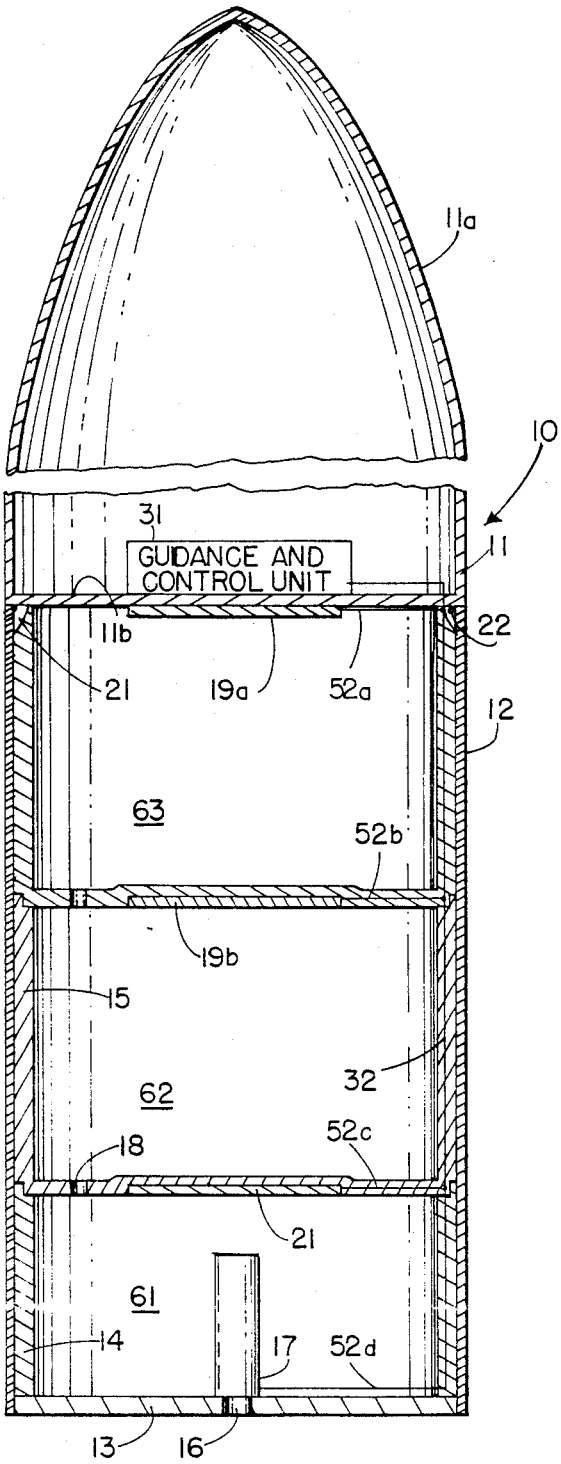
FIG. 1 illustrates a traveling charge according to the invention.

Referring now to the drawing wherein like parts and elements are designated by like reference characters throughout the several views, and in particular referring to FIG. 1, there is shown a sectional view of a traveling charge projectile 10. Projectile warhead 11 is shown joined to traveling charge case 12 at joint 21 by conventional mechanical means such as welding, fasteners, screw threads or shrink fit, for example. Projectile warhead 11 has forward end 11*a* and aft end 11*b*.

Retained within traveling charge case 12 is a plurality of traveling charge segments 61, 62, and 63, for example, which provide improved projectile propulsion as will be explained below. Each traveling charge segment except the first one, that is the segment furthest aft, is contained within a consumable cup 15, which insulates its contained charge from ignition by the aft adjacent charge. Each consumable cup has on its aft side, a primer recess 21, into which is retained an igniting-priming-expelling charge such as 19*a* or 19*b*, for the charge immediately behind it. All consumable components such as cup 15 are made from a material which will burn completely during projectile firing so as to prevent expulsion of debris following projectile muzzle exit. This material could be a carbon fiber or glass fiber material or some other synthetic composite material which is well within the state of the art of rocketry and caseless ammunition.

It may be seen that the aft most cup does not require an igniting-priming-expelling charge since the first charge segment 61 is ignited by primer-igniter 17 upon initiation of the projectile. Primer-igniter 17 is an electrically or percussion ignited primer. The first charge segment 61 is contained within consumable sleeve 14 and is closed on the aft end by consumable base 13.

Electrical contact 16 communicates external firing signals to primer-igniter 17. Electrical paths 52*a*, 52*b*, 52*c*, 52*d* and 32 serve to link guidance and control unit 31 with igniter-primer-expelling charges 19*a* and 19*b* as well as primer-igniter 17. Electrical paths 52*a–d* and 32 are embedded in the walls of consumable cups 15 and equivalent structures during manufacture.

Referring now to FIG. 3, there is shown electrical connector 51 which facilitates automated assembly of traveling charge projectiles by connecting electrical paths such as 52*b* with electrical paths such as 32 at the junction of the second and third charge segments, for example. Connector 51 is selected to provide the proper number of electrical conductors and to provide a reliable connection between paths in adjacent consumable cups during automated assembly of traveling charge segments. Connector 51 should be able to tolerate a predetermined degree of misalignment as would be expected, depending upon the accuracy of robotic assembly methods employed. This connector is well within the current state of the art. Appropriate connectors are available from a variety of manufacturers in the commercial market.

Use of explosive cutting cord 22 is optional. Explosive cutting cord 22 encircles the inside of traveling charge case 12 at its junction with projectile warhead 11. After traveling charge projectile 10 has been launched, explosive cord 22 may be initiated under the control of guidance and control unit 31 to separate spent traveling charge case 12 from warhead 11. Such separation may be desired, for example, to provide better aerodynamic characteristics for the projectile warhead. Alternatively, such separation may not be desired, in which case either guidance and control unit 31 is programmed to not fire explosive cord 22, or explosive cord 22 may be omitted from the traveling charge projectile entirely.

Passageways 18 are provided between each consumable cup 15 so that as the traveling charge projectile 10 is being assembled, liquid propellant may be injected into the aft adjacent charge segment and the passageways 18 subsequently sealed. Liquid propellant increases the mass and energy of the charge segment, while expanding the consumable cup 15 or consumable sleeve 14 firmly against the traveling charge case 12 and assures that the sleeve is evenly cemented to the case wall. Liquid propellant injection also serves to uniformly distribute set back forces during launch of the projectile.

Figure 4:
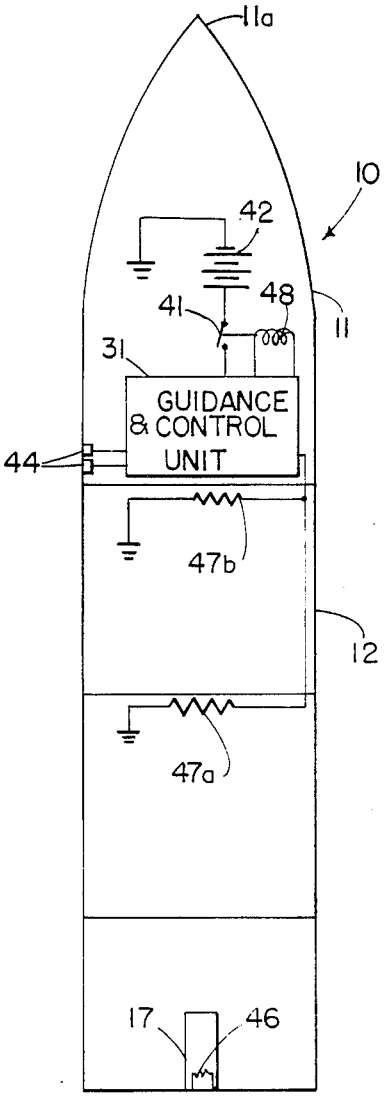
FIG. 4 illustrates an implementation of the present invention where traveling charge segments are sequentially fired by the warhead guidance system.

Referring now to FIGS. 2 and 4, the electrical circuitry employed by the present invention is shown in two alternate forms. FIG. 2 illustrates the general arrangement required to control a traveling charge propulsion system. Latching relay 48 is activated by an external electric firing pulse which also causes bridge wire 46 to fire within primer-igniter 17. Alternately, primer-igniter 17 can be percussion fired in which case the switch 41 will be closed by projectile acceleration to activate the energy storage element 42 and provide electric power to the rest of the circuitry.

Latching relay 48, triggered by the electrical firing pulse, operates switch 41, which may also be implemented in solid state circuitry, to apply a voltage from energy storage element 42 to activate crystal oscillator clock 43 and microprocessor and Electronically Erasable Programmable Read Only Memory (EEPROM) 45. Microprocessor and EEPROM 45 then calculates predetermined firing sequence delays, based upon instructions previously stored in the EEPROM pertaining to projectile mass, coefficients of friction, propellant characteristics, optimum muzzle velocity and other relevant factors such as the laws of physics, according to conventional methods, then causes bridge wires 47*a* and 47*b* to fire in timed sequence. Each of bridge wires 47*a* and 47*b* is embedded respectively in igniting-priming-expelling charges 19*a*, 19*b*. If more igniting-priming-expelling charges are used, there would be an equal number of bridge wires controlled by microprocessor and EEPROM 45.

Programming contact pads 44 are located on the external surface of traveling charge projectile 10 to provide an electrical path for signal transmission so that microprocessor and EEPROM 45 may be programmed or reprogrammed electrically up to the last instant prior to firing. Thus, the firing timing sequence may be altered or, if projectile guidance is the issue, the destination or flight profile of the traveling charge projectile 10 may be modified by supplying appropriate instructions to microprocessor and EEPROM 45. Such instructions would probably be communicated automatically by an external fire control computer which is in electrical contact with the programming contact pads 44. If more than two pads 44 were required, of course they would be provided, depending upon the input/output requirements of the microprocessor and EEPROM 45.

The present invention may be best implemented principally in one of two forms. Type one is the simplest, cheapest, lightest and smallest volume method and would be applicable to mass produced high velocity rounds suitable for either spin stabilized or guided projectiles. With spin stabilization, barrel elevation would be changed to adjust range based on observed fall of shot. In guided rounds the guidance system would take care of small variations of muzzle velocity. The integrated circuitry firing mechanism will be contained in the traveling charge or the warhead to best suit the particular application and will have the complexity, weight, volume and cost of a good quality digital wrist watch. It will operate as follows:

(1) The gun provides an electrical pulse through the base of the round which closes latching relay 48 to power the timing mechanism and fire the first segment.

(2) The EEPROM of the computer may be programmed during production to fire the remaining charges at intervals which have been established by test firings of the round and gun type. As an alternative, an EEPROM may be used which is programmable from two or more electrical contact pads on the side of the round. Timing could then be changed to alter muzzle velocity to suit various atmospheric and geodesic conditions or missions.

The type two version of the present invention utilizes an inertial platform contained in guidance and control unit 31 to measure projectile acceleration in the gun barrel from which the microprocessor will calculate velocity and fire all charge segments after the first, to obtain the muzzle velocity required for the mission. The necessary data will be programmed into the guided projectile just prior to loading the round when the battery 42 will be activated so that the inertial system may be aligned and initialized and the geodesic coordinates of the target fed into the EEPROM.

The preferred method of assembling the traveling charge projectile is shown in FIG. 1.

(A) The empty traveling charge case 12 with consumable base 13 and primer-igniter 17 and insulating consumable sleeve 14 cemented in place against the inner surface of traveling charge case 12 is mounted on a loading stand or conveyor. A fixed quantity of granular propellant is then added to form the first charge segment 61.

(B) A standard consumable cup 15 for the second charge segment is held above the traveling charge case and aligned axially so that the connector 51 in FIG. 3 will engage with its mating half in sleeve 14 when cup 15 is lowered into place (alternatively appropriate wires of connecting pigtails may be crimped together before the cup 15 is lowered into place). The second consumable cup 15 is then lowered and cemented in place against traveling charge case 12. If desired, liquid propellant can now be injected through hole 18 to completely fill the first charge cavity, expand the cup against the case to assure good adhesion and distribute set back pressure evenly over the case wall. The filling hole 18 will then be plugged.

(C) The second charge cavity is then filled with a fixed quantity of smaller grain powder (to obtain faster burning), the third charge cup axially aligned and lowered and cemented in place. Liquid propellant may then be added as before.

(D) This process is repeated with the third and subsequent cups, depending upon how many charge segments are desired.

The individual traveling charge segments each are filled with conventional granular propellant. The grain size of propellant used becomes progressively smaller toward the forward end of the traveling charge assembly. The actual grain sizes selected depend upon the burn rates required to produce optimum muzzle velocity. Smaller grain sizes present a greater surface area per unit volume and burn faster than larger grain sizes. The first charge segment is the slowest burning propellant because the projectile is initially at rest. As the projectile is accelerated by the first charge segment, the microprocessor delays a predetermined time period, then sends a firing signal to the igniting-priming-expelling charge 19*b*. This charge fires, igniting the propellant in charge segment 62 and expelling it into the hot expanding gases in the increasing volume aft of the accelerating projectile in the breech of the gun barrel. As the projectile continues to move toward the muzzle of the gun barrel, the microprocessor delays a second time period, then fires the igniting-priming-expelling charge 19*a* to ignite the propellant in the charge segment 63 and expel it into the increasing volume of hot expanding gasses aft of the projectile. The projectile now reaches the muzzle and exits the gun barrel with optimum and very high muzzle velocity.

I claim:

1. A traveling charge projectile comprising:

a hollow cylindrical projectile body having a central payload cavity, an aft end and a front end;

a plurality of propellant charge segments, each containing granular propellant of progressively smaller grain size, mounted in a stacked column for sequential initiation, and attached to the aft end of said projectile body;

a plurality of electrically initiated propellant charge segment initiators, each mounted on a different one of said propellant charge segments, for sequential initiation by a remote firing signal for igniting and propelling granular propellant into the volume aft of said projectile body when said projectile is fired in a gun barrel;

means electrically connected to said plurality of electrically initiated propellant charge segment initiators for initiating said initiators in response to an external firing signal; and means for generating a firing signal indicative of optimum propellant charge segment initiation sequence timing including means for measuring projectile instantaneous velocity while said projectile is traversing said gun barrel and means responsive to projectile instantaneous velocity for providing timed initiation pulses to the respective propellant charge segments which further comprises:

an electrical relay, which controls electric current in response to acceleration, positionable between an open position interrupting the flow of electric current and a closed position permitting the flow of electric current, for initiating the firing process;

an electricity storage member electrically connected to said electrical relay for providing electric power if said relay is in the closed position;

a crystal oscillator clock, electrically connected to said electricity storage member for providing a periodic signal when said electrical relay is in the closed position;

a microprocessor having an associated electronically erasable programmable read only memory, electrically connected to said crystal oscillator clock and said means for measuring projectile instantaneous velocity while said projectile is traversing said gun barrel; and a plurality of bridge wires, each electrically connected to said microprocessor, and each positioned within a separate one of said plurality of electrically initiated propellant charge initiators;

said means for generating a firing signal being electrically connected to each of said plurality of electrically initiated propellant charge segment initiators.

2. A traveling charge projectile as set forth in claim 1, further comprising a hollow cylindrical traveling charge case frangibly attached to the aft end of said cylindrical projectile body and holding said plurality of propellant charge segments assembled in said stacked column.

3. A traveling charge projectile as set forth in claim 2, further comprising a plurality of consumable insulated cups each having a closed end and an open end, said closed end being oriented aft, and each cup containing one of said plurality of propellant charge segments, the exterior of each insulated cup being bonded to the inner surface of said hollow cylindrical traveling charge case to prevent the passage of hot gases between the segments and the side of the traveling charge case.

4. A traveling charge projectile as set forth in claim 1, wherein each of said propellant charge segments is comprised of granular gun propellant which, upon initiation of the electrically initiated propellant charge segment initiator for that segment, is propelled into the space aft of the projectile where it burns at a rate inversely proportional to its grain size.

5. A traveling charge projectile as set forth in claim 1, wherein each of said plurality of propellant charge segments includes a combustion inhibiting insulator surrounding the charge segment to prevent untimely ignition of each segment.

6. A traveling charge projectile as set forth in claim 1, wherein said plurality of propellant charge segments have gun propellant grain sizes which range continuously from a larger grain size in the aft most charge segment for an initial burn rate and initial projectile acceleration to progressively smaller grain sizes toward the front of the propellant charge segment stack for ignition at a progressively faster burn rate as the projectile accelerates in the gun barrel.

7. A traveling charge projectile as set forth in claim 1, wherein each of said electrically initiated propellant charge segment initiators comprises an igniter charge and a primer having a pair of firing leads and a firing bridge wire embedded in said primer, said firing leads being electrically connected to said means for generating a firing signal.

8. A traveling charge projectile as set forth in claim 1, wherein said electrical relay is a latching relay which controls electric current in response to a signal.

9. A traveling charge projectile as set forth in claim 1, wherein said electrical relay is an inertia switch which controls electric current in response to acceleration, which would be used if the traveling charge is initiated by a percussion cap.

10. A traveling charge projectile as set forth in claim 1, wherein said propellant charge segments each further comprise a mixture of granular propellant and liquid propellant.

11. A traveling charge projectile comprising:

a hollow cylindrical projectile body having a central payload cavity, an aft end and a front end;

a plurality of propellant charge segments, each containing granular propellant of progressively smaller grain size, mounted in a stacked column for sequential initiation, and attached to the aft end of said projectile body;

a plurality of electrically initiated propellant charge segment initiators, each mounted on a different one of said propellant charge segments, for sequential initiation by a remote firing signal for igniting and propelling granular propellant into the volume aft of said projectile body when said projectile is fired in a gun barrel;

means electrically connected to said plurality of electrically initiated propellant charge segment initiators for initiating said initiators in response to an external firing signal;

means for generating a firing signal indicative of optimum propellant charge segment initiation sequence timing, said means for generating a firing signal being electrically connected to each of said plurality of electrically initiated propellant charge segment initiators;

acceleration sensing means mounted on said projectile body and adapted for measuring acceleration of said projectile body; and computing means including memory means mounted on said projectile body and communicating with said acceleration sensing means and said electrically initiated propellant charge segment initiators for generaring a remote signal toselectively initiate said propellant charge segments according to a predetermined sequence in response to acceleration sensed by said acceleration sensing means.

12. A traveling charge projectile as set forth in claim 11, further comprising a hollow cylindrical traveling charge case frangibly attached to the aft end of said cylindrical projectile body and holding said plurality of propellant charge segments assembled in said stacked column.

13. A traveling charge projectile as set forth in claim 12, further comprising a plurality of consumable insulated cups each having a closed end and an open end, said closed end being oriented aft, and each cup containing one of said plurality of propellant charge segments, the exterior of each insulated cup being bonded to the inner surface of said hollow cylindrical traveling charge case to prevent the passage of hot gases between the segments and the side of the traveling charge case.

14. A traveling charge projectile as set forth in claim 11, wherein each of said propellant charge segments is comprised of granular gun propellant which, upon initiation of the electrically initiated propellant charge segment initiator for that segment, is propelled into the space aft of the projectile where it burns at a rate inversely proportional to its grain size.

15. A traveling charge projectile as set forth in claim 11, wherein each of said plurality of propellant charge segments includes a combustion inhibiting insulator surrounding the charge segment to prevent untimely ignition of each segment.

16. A traveling charge projectile as set forth in claim 11, wherein said plurality of propellant charge segments have gun propellant grain sizes which range continuously from a larger grain size in the aft most charge segment for an initial burn rate and initial projectile acceleration to progressively smaller grain sizes toward the front of the propellant charge segment stack for ignition at a progressively faster burn rate as the projectile accelerates in the gun barrel.

17. A traveling charge projectile as set forth in claim 11, wherein each of said electrically initiated propellant charge segment initiators comprises an igniter charge and a primer having a pair of firing leads and a firing bridge wire embedded in said primer, said firing leads being electrically connected to said means for generating a firing signal.

18. A traveling charge projectile as set forth in claim 11, wherein said propellant charge segments each further comprise a mixture of granular propellant and liquid propellant.

* * * * *